US007862386B2

(12) United States Patent
Hsu et al.

(10) Patent No.: US 7,862,386 B2
(45) Date of Patent: Jan. 4, 2011

(54) POWER CONNECTOR AND POWER SUPPLY CORD SET HAVING SUCH POWER CONNECTOR

(75) Inventors: Jui-Yuan Hsu, Taoyuan Hsien (TW); Ya-Hui Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/501,550

(22) Filed: Jul. 13, 2009

(65) Prior Publication Data

US 2010/0124853 A1 May 20, 2010

(30) Foreign Application Priority Data

Nov. 17, 2008 (TW) ..... 97144419 A

(51) Int. Cl.
*H01R 24/00* (2006.01)

(52) U.S. Cl. ..... 439/675

(58) Field of Classification Search ..... 439/675, 439/874, 875, 578, 582, 583
See application file for complete search history.

(56) References Cited

U.S. PATENT DOCUMENTS 6,149,461 A * 11/2000 Emery ..... 439/578
7,008,273 B2 * 3/2006 Zhou ..... 439/874
7,677,916 B2 * 3/2010 Chang ..... 439/490
7,686,657 B1 * 3/2010 Chan et al. ..... 439/668

* cited by examiner

*Primary Examiner*—Jean F Duverne
(74) *Attorney, Agent, or Firm*—Kirton & McConkie; Evan R. Witt

(57) ABSTRACT

A power supply cord set includes a power connector and a power cord. The power connector includes an insulating body, a first conducting element and a second conducting element. The second conducting element includes a first conducting part having a first connecting segment and a second connecting segment. The power cord includes a first multi-core wire and a second multi-core wire, which are covered by the external insulating cover layer. The internal insulating cover layer is partially extended out of a distal aperture of the external insulating cover layer. The bare wire portion of the first multi-core wire is fixed on the first conducting element of the power connector. The bare wire portion of the second multi-core wire is fixed on the first connecting segment of the second conducting element. A terminal part of the internal insulating cover layer is fixed by the second connecting segment.

18 Claims, 18 Drawing Sheets

5

2

5

51

5

51

5

POWER CONNECTOR AND POWER SUPPLY CORD SET HAVING SUCH POWER CONNECTOR

FIELD OF THE INVENTION

The present invention relates to a connector, and more particularly to a power connector. The present invention also relates to a power supply cord set having such a power connector.

BACKGROUND OF THE INVENTION

Power supply cord sets have been widely used to transmit electricity from power sources or power adapters to power-receiving devices. Generally, a power supply cord set includes a power connector and a power cord. The power connector is fixed onto an end of the power cord and detachably connected to a corresponding electrical connector of an electrical appliance. Through the power supply cord set, electricity can be transmitted from a power source or a power adapter to the electrical appliance.

FIG. 1 is a schematic perspective view illustrating a power supply cord set for use with a power adapter according to the prior art. In FIG. 1, the power adapter 1 is interconnected between a power source (e.g. a utility power source) and an electrical appliance (e.g. a notebook computer) for receiving utility power and converting the utility power into a DC voltage required for powering the electrical appliance. As shown in FIG. 1, the power adapter 1 principally comprises a power supply cord set 2, a power converter main body 3 and an AC power supply cord set 4. The power supply cord set 2 comprises a power connector 20 and a power cord 21. A first end of the power cord 21 is connected to a power converting circuit within the power converter main body 3. A second end of the power cord 21 is connected to the power connector 20. The power connector 20 is detachably connected to a corresponding electrical connector of the electrical appliance (e.g. a notebook computer). By the power converting circuit within the power converter main body 3, the utility power is converted into a DC voltage required for powering the electrical appliance. A first end of the AC power supply cord set 4 is connected to the power converting circuit within the power converter main body 3. A plug is formed at a second end of the AC power supply cord set 4. The plug is detachable connected to the utility power source for receiving the utility power and delivering the utility power to the power converter main body 3.

FIG. 2 is a schematic cross-sectional view illustrating connection between the power connector and the power cord of the power supply cord set shown in FIG. 1. As shown in FIG. 2, the power connector 20 of the power supply cord set 2 comprises an insulating body 201, a first conducting element 202 and a second conducting element 203. The insulating body 201 has an external surface 204, a receptacle 205, a first opening 206 and a second opening 207. The first opening 206 and the second opening 207 are disposed on opposite ends of the insulating body 201. The first opening 206 and the second opening 207 are communicated with the receptacle 205. The first conducting element 202 is arranged on the external surface 204 of the insulating body 201. The second conducting element 203 is disposed within the receptacle 205. The second conducting element 203 has a first conducting part 203*a* extended externally from the first opening 206.

The power cord 21 of the power supply cord set 2 comprises an external insulating cover layer 210 and two wires 211 and 212. The wires 211 and 212 are sheathed by the internal insulating cover layers 213 and 214, respectively. By the internal insulating cover layers 213 and 214, the wires 211 and 212 are isolated from each other. The internal insulating cover layers 213 and 214 are partially extended out of a distal aperture 210*a* of the external insulating cover layer 210. In addition, the wires 211 and 212 have respective bare wire portions 211*a* and 212*a* at their terminals. The bare wire portion 211*a* of the wire 211 is welded on the first conducting element 202 of the power connector 20. The bare wire portion 212*a* of the wire 212 is welded on the first conducting part 203*a* of the second conducting element 203 of the power connector 20. The power supply cord set 2 further comprises an insulating protective layer 22. The insulating protective layer 22 is sheathed around the connection area between the power cord 21 and the power connector 20 such that the first conducting element 202 of the power connector 20 is partially exposed. After the power connector 20 is coupled with a corresponding electrical connector of an electrical appliance, the first conducting element 202 and the second conducting part 203*b* of the second conducting element 203 are in close contact with corresponding conducting parts of the electrical connector of the electrical appliance so as to transmit electricity to the electrical appliance.

The power supply cord set, however, still has some drawbacks. For example, after the insulating protective layer 22 is sheathed around the connection area between the power cord 21 and the power connector 20, the bare wire portions 211*a* and 212*a* are readily contacted with each other and thus a short-circuit problem occurs. In addition, if the power supply cord set 2 has been used for a long period, the internal insulating cover layers 213 and 214 are possibly shrunk toward the distal aperture 210*a* of the external insulating cover layer 210. Under this circumstance, the lengths of the bare wire portions 211*a* and 212*a* are increased. Therefore, the possibility of causing the short-circuit problem is increased and the power converter 1 has a breakdown.

There is a need of providing an improved an electrical connector and a power supply cord set having such an electrical connector so as to obviate the drawbacks encountered from the prior art.

SUMMARY OF THE INVENTION

It is an object of the present invention to provide a power connector and a power supply cord set having such a power connector so as to securely fix the bare wire portions and prevent a short-circuited problem.

In accordance with an aspect of the present invention, there is provided a power supply cord set. The power supply cord set includes a power connector and a power cord. The power connector includes an insulating body, a first conducting element and a second conducting element. The insulating body is arranged between the first conducting element and the second conducting element such that the first conducting element is isolated from the second conducting element by the insulating body. The second conducting element includes a first conducting part, which is disposed outside the insulating body and includes a first connecting segment and a second connecting segment. The power cord includes a first multi-core wire, a second multi-core wire and an external insulating cover layer. The first multi-core wire and the second multi-core wire are covered by the external insulating cover layer. The second multi-core wire is sheathed by an internal insulating cover layer such that the first multi-core wire and the second multi-core wire are isolated from each other. The first multi-core wire and the second multi-core wire have respective bare wire portions. The internal insulating cover layer is partially extended out of a distal aperture of the external insulating cover layer. The bare wire portion of the first multi-core wire is connected to and fixed on the first conducting element of the power connector. The bare wire portion of the second multi-core wire is connected to and fixed on the first connecting segment of the first conducting part of the second conducting element. A terminal part of the internal insulating cover layer is fixed by the second connecting segment.

In accordance with another aspect of the present invention, there is provided a power connector to be coupled with a power cord. The power cord includes a first multi-core wire and a second multi-core wire. The power connector includes a first conducting element, a second conducting element and an insulating body. The second conducting element includes a first conducting part, which includes a first connecting segment and a second connecting segment. The insulating body is arranged between the first conducting element and the second conducting element such that the first conducting element is isolated from the second conducting element by the insulating body. The first conducting part of the second conducting element is disposed outside the insulating body. The bare wire portion of the first multi-core wire is connected to and fixed on the first conducting element of the power connector. The bare wire portion of the second multi-core wire is connected to and fixed on the first connecting segment of the first conducting part of the second conducting element. A terminal part of an internal insulating cover layer of the second multi-core wire is fixed by the second connecting segment.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
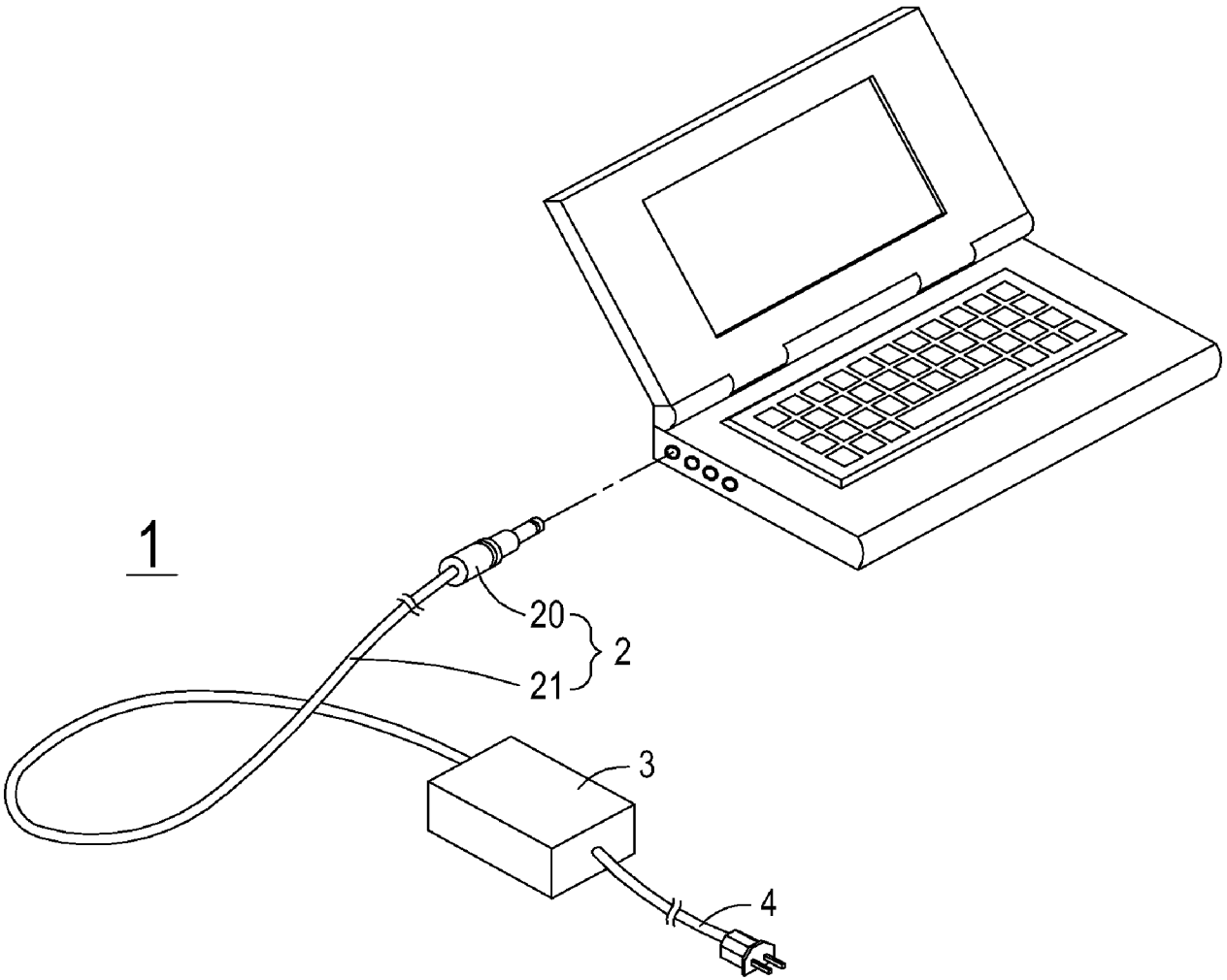
FIG. 1 PRIOR ART
FIG. 1 is a schematic perspective view illustrating a power supply cord set for use with a power adapter according to the prior art.
Figure 2:
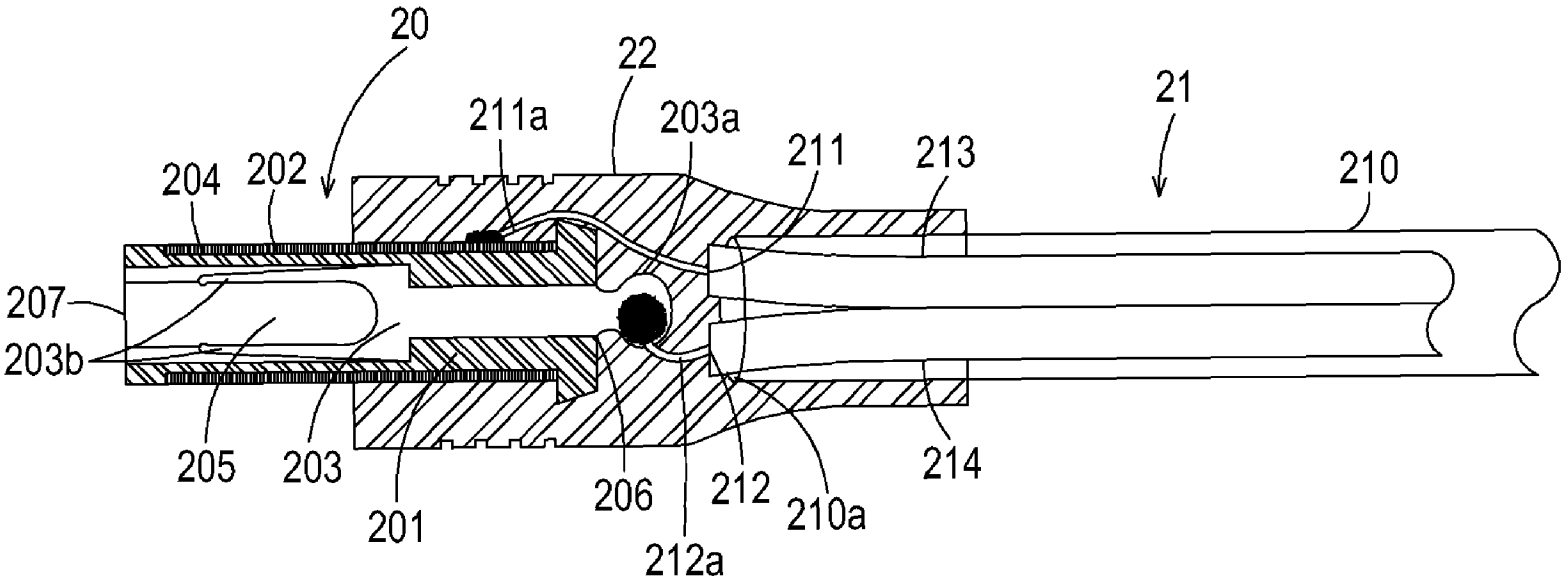
FIG. 2 is a schematic cross-sectional view illustrating connection between the power connector and the power cord of the power supply cord set shown in FIG. 1.
Figure 3:
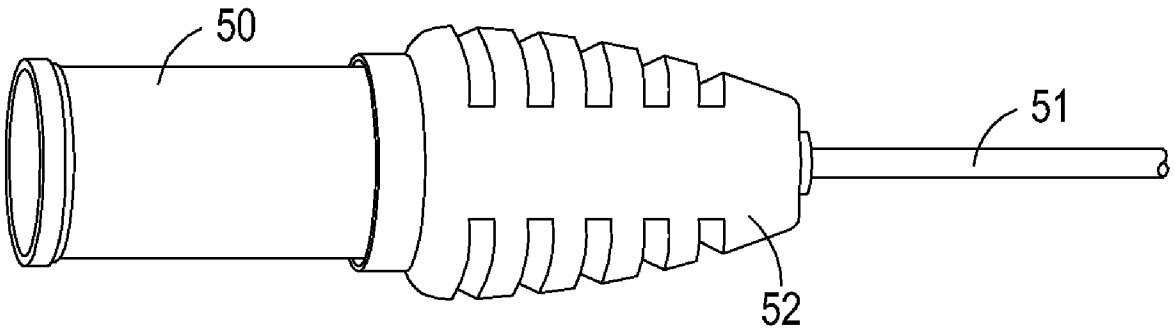
FIG. 3 is a schematic perspective view of a power supply cord set according to a preferred embodiment of the present invention.

FIG. 3 is a schematic perspective view of a power supply cord set according to a preferred embodiment of the present invention. As shown in FIG. 3, the power supply cord set 5 comprises a power connector 50 and a power cord 51. The power connector 50 is fixed onto an end of the power cord 51 and detachably connected to a corresponding electrical connector of an electrical appliance. Through the power supply cord set 5, electricity can be transmitted from a power source or a power adapter to the electrical appliance. The power supply cord set 5 further comprises an insulating protective layer 52. The insulating protective layer 52 is sheathed around the connection area between the power cord 51 and the power connector 50 for protecting the connection area and alleviating the stress exerted on the connection area. The insulating protective layer 52 of the power supply cord set 5 is formed by plastic molding. In addition, the power connector 50 and the power cord 51 are arranged along the coaxial line.

Figure 4A:
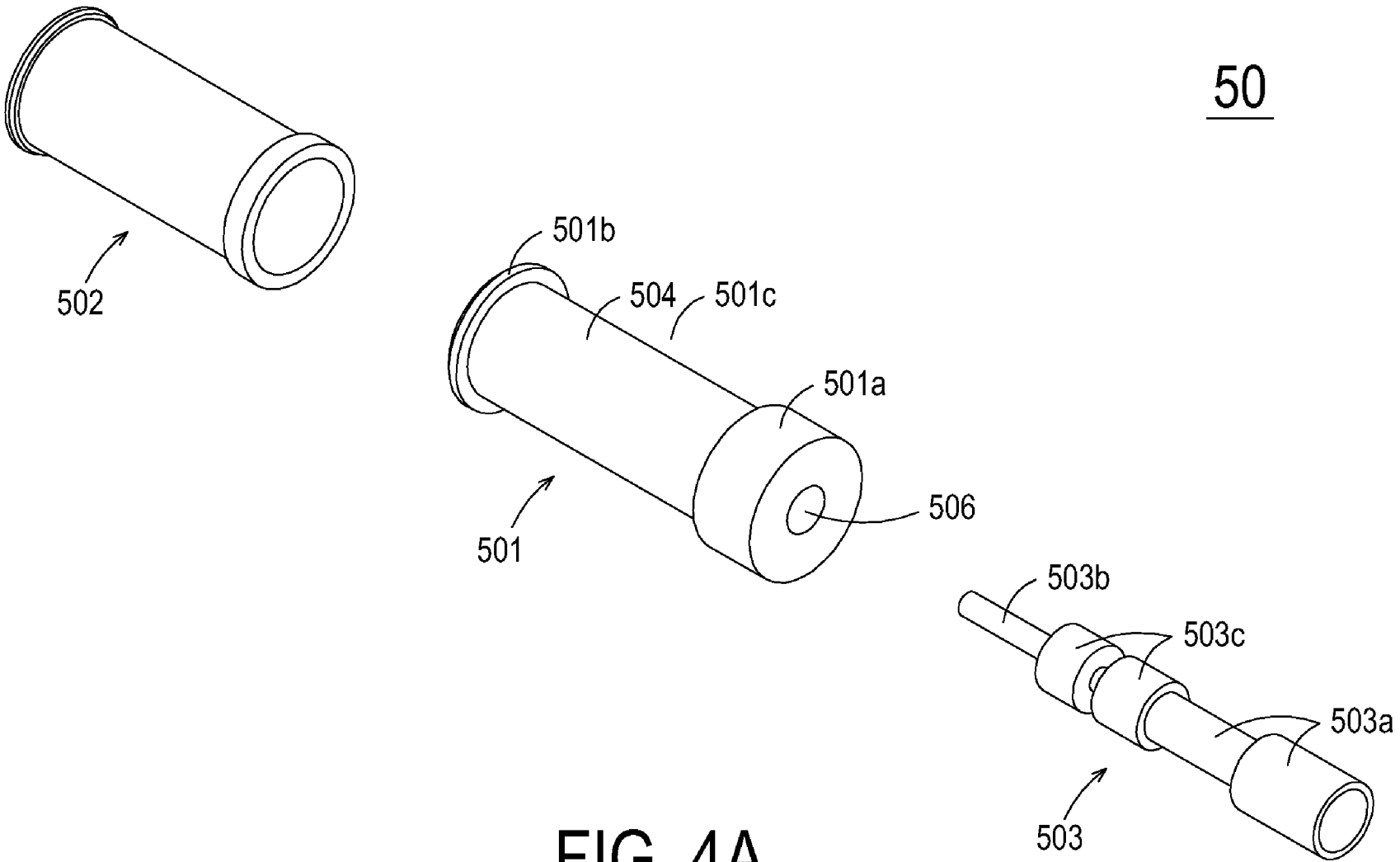
FIG. 4A is a schematic exploded view illustrating an exemplary power connector of the power supply cord set shown in FIG. 3.
Figure 4B:
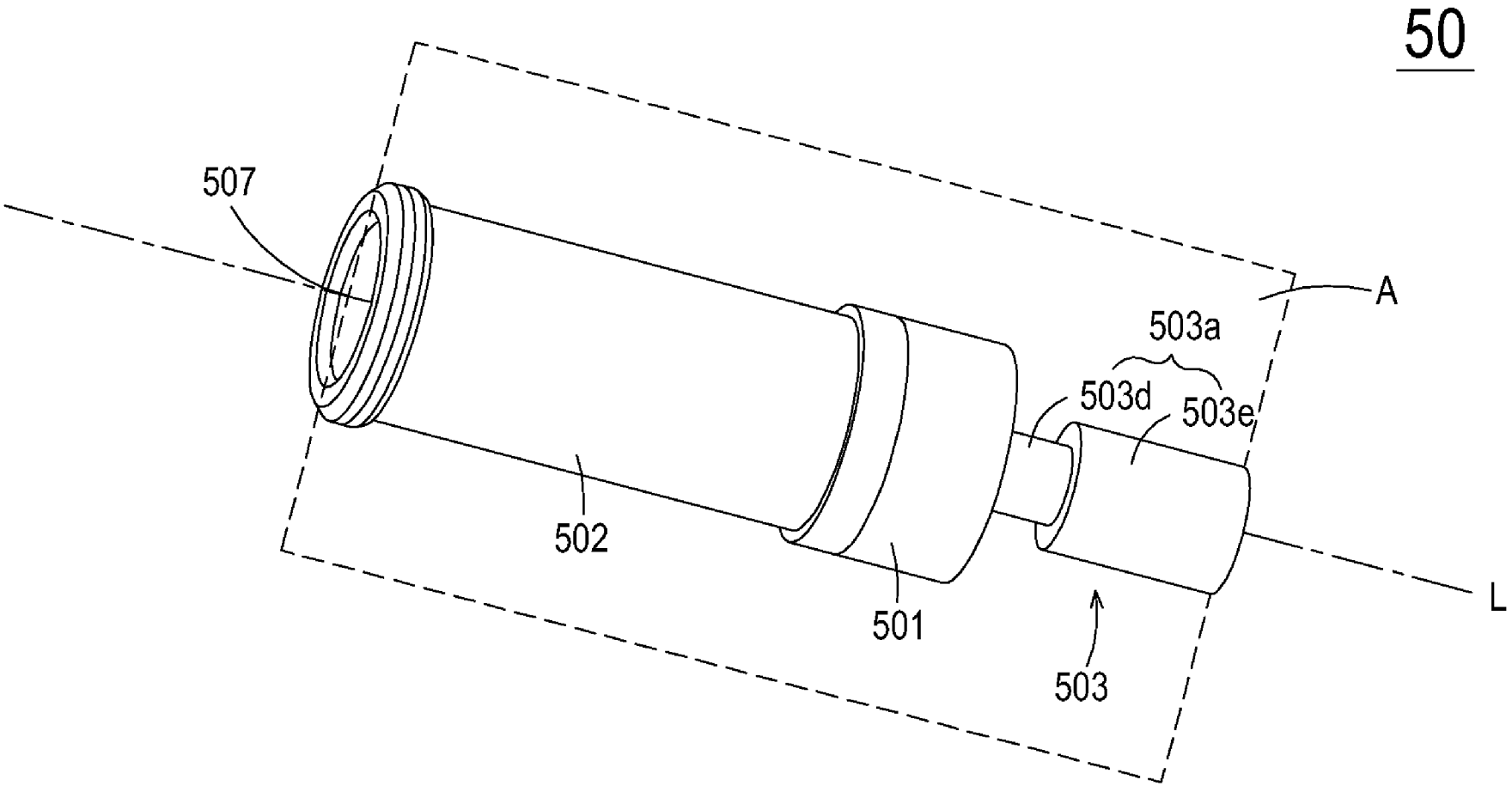
FIG. 4B is a schematic assembled view illustrating the power connector shown in FIG. 4A.
Figure 4C:
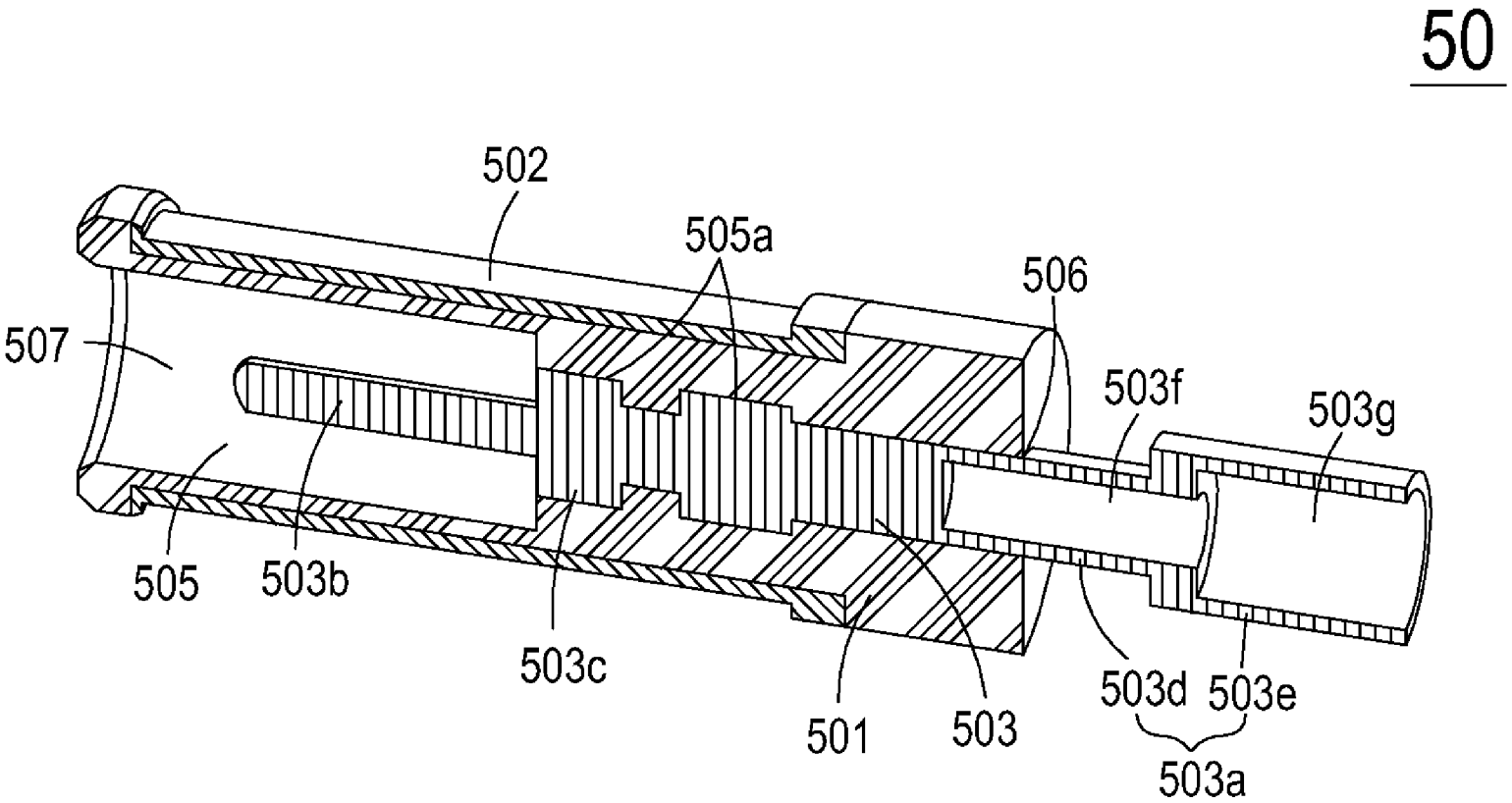
FIG. 4C is a schematic cross-sectional view of the power connector of FIG. 4B taken from the cross-section A.

FIG. 4A is a schematic exploded view illustrating an exemplary power connector of the power supply cord set shown in FIG. 3. FIG. 4B is a schematic assembled view illustrating the power connector shown in FIG. 4A. FIG. 4C is a schematic cross-sectional view of the power connector of FIG. 4B taken from the cross-section A. Please refer to FIGS. 4A, 4B and 4C. In this embodiment, the power connector 50 of the power supply cord set 5 is substantially a barrel power plug. The power connector 50 comprises an insulating body 501, a first conducting element 502 and a second conducting element 503. The insulating body 501 is barrel-shaped. A first protruded ring 501*a* and a second protruded ring 501*b* are respectively formed at a first end and a second end of the insulating body 501 such that a concave portion 501*c* is arranged between the first protruded ring 501*a* and the second protruded ring 501*b*. The insulating body 501 has an external surface 504, a receptacle 505, a first opening 506 and a second opening 507. The first conducting element 502 is also barrel-shaped. The first conducting element 502 is sheathed around the external surface 504 at the concave portion 501*c* of the insulating body 501. The second conducting element 503 is disposed within the receptacle 505. The second conducting element 503 has a first conducting part 503*a* protruded out of the insulating body 501. That is, the first conducting part 503*a* is extended externally from the first opening 506 of the insulating body 501. The second conducting element 503 is separated and isolated from the first conducting element 502 by the insulating body 501. The second conducting element 503 and the first conducting element 502 are arranged along the coaxial line L. The first opening 506 and the second opening 507 are disposed on opposite ends of the insulating body 501. The first opening 506 and the second opening 507 are communicated with the receptacle 505. The second conducting element 503 has at least a second conducting part 503*b*, which is accommodated in the receptacle 505. In this embodiment, the second conducting part 503*b* is a conducting post. The second conducting element 503 further comprises a first engaging part 503*c*, which is arranged between the first conducting part 503*a* and the second conducting part 503*b* of the second conducting element 503. Corresponding to the first engaging part 503*c*, the insulating body 501 has a second engaging part (not shown) within the receptacle 505. In some embodiments, the first engaging part 503*c* includes at least one protruded ring and the second engaging part includes at least one recess. After the first engaging part 503*c* is engaged with the second engaging part, the second conducting element 503 is firmly fixed on the insulating body 501. Likewise, the first conducting part 503*a* and the second conducting part 503*b* of the second conducting element 503 are arranged along the coaxial line L.

Please refer to FIGS. 4A, 4B and 4C again. The first conducting part 503*a* of the second conducting element 503 comprises a first connecting segment 503*d* and a second connecting segment 503*e*. The first connecting segment 503*d* and the second connecting segment 503*e* are integrally formed. The first connecting segment 503*d* and the second connecting segment 503*e* have a first hollow portion 503*f* and a second hollow portion 503*g*, respectively. The first hollow portion 503*f* and the second hollow portion 503*g* are communicated with each other. The diameter of the first hollow portion 503*f* is smaller than that of the second hollow portion 503*g*.

Figure 5:
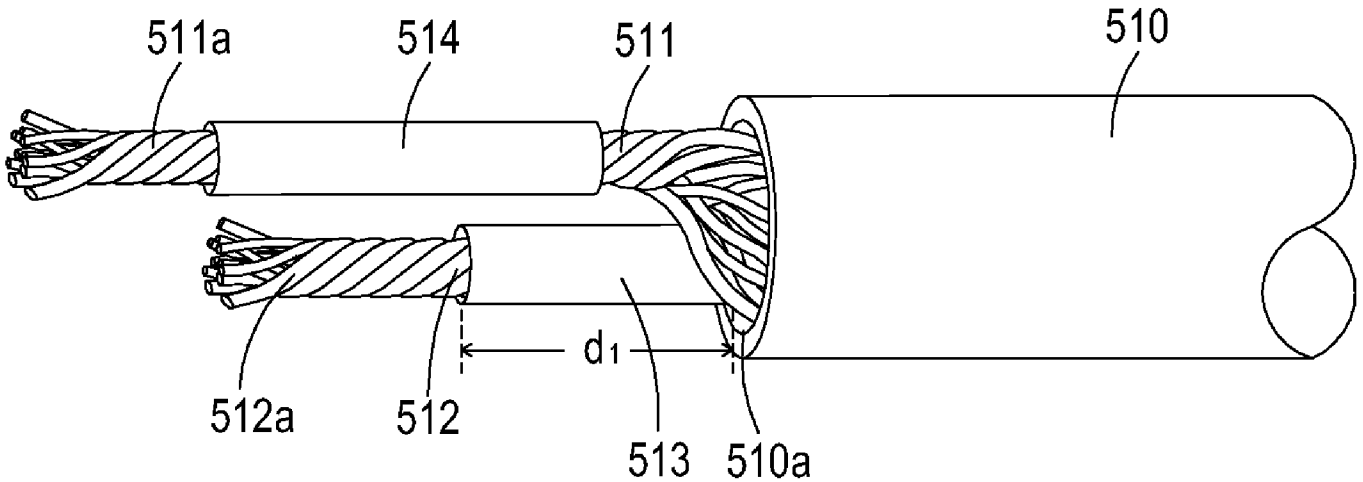
FIG. 5 is a schematic view illustrating the power cord of the power supply cord set shown in FIG. 3.

FIG. 5 is a schematic view illustrating the power cord of the power supply cord set shown in FIG. 3. An example of the power cord includes but is not limited to a coaxial power cord. The power cord 51 of the power supply cord set 5 comprises an external insulating cover layer 510 and at least two multi-core wires 511 and 512. The first multi-core wire 511 and the second multi-core wire 512 are covered by the external insulating cover layer 510. The second multi-core wire 512 is sheathed by an internal insulating cover layer 513. The first multi-core wire 511 is arranged between the internal insulating cover layer 513 and the external insulating cover layer 510 such that the first multi-core wire 511 and the second multi-core wire 512 are isolated from each other. The internal insulating cover layer 513 of the second multi-core wire 512 is partially extended out of a distal aperture 510*a* of the external insulating cover layer 510 by a length $d_1$. The first multi-core wire 511 and the second multi-core wire 512 have respective bare wire portions 511*a* and 512*a* at their terminals. In addition, the bare wire portion 511*a* of the first multi-core wire 511 is partially sheathed by an insulating tube 514.

Figure 6:
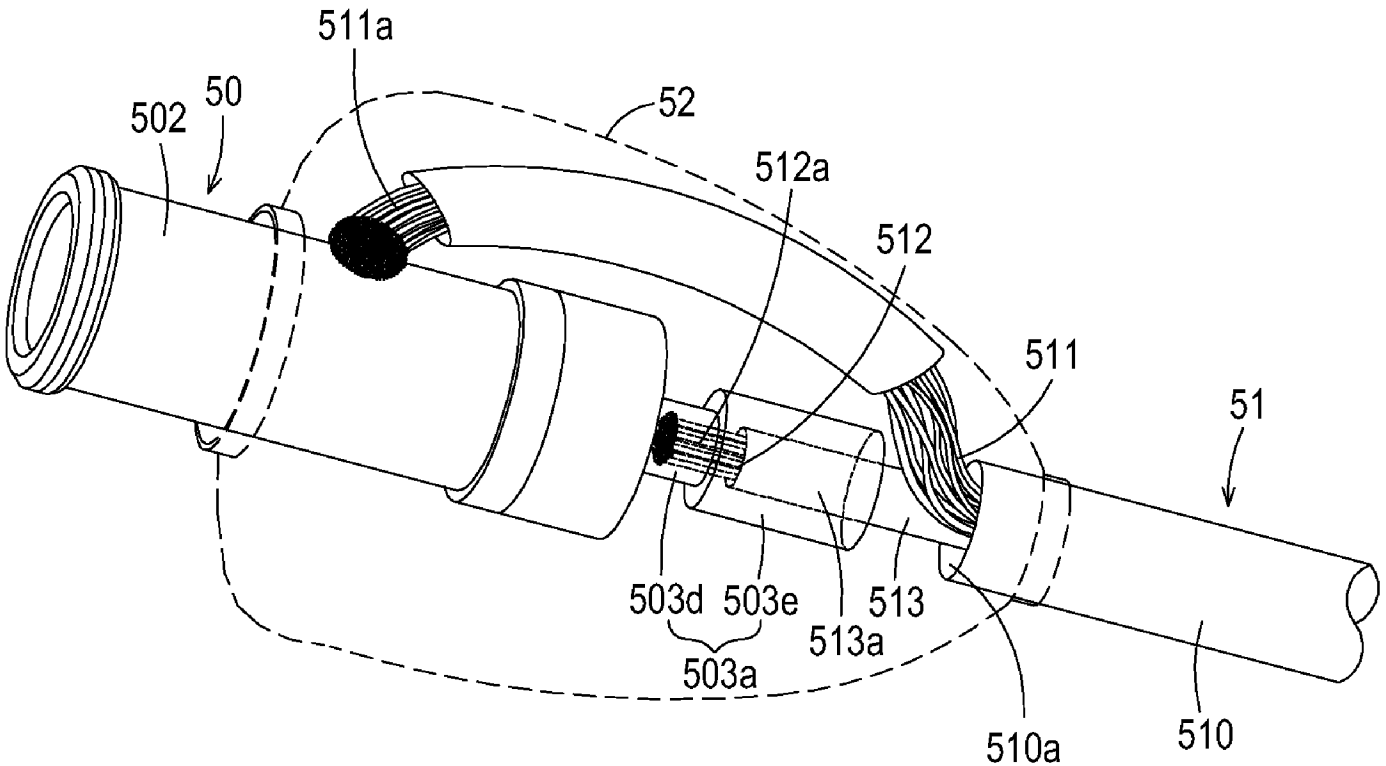
FIG. 6 is a schematic perspective view illustrating the connection between the power connector of FIG. 4 and the power cord of FIG. 5.

FIG. 6 is a schematic perspective view illustrating the connection between the power connector of FIG. 4 and the power cord of FIG. 5. Please refer to FIGS. 3, 4A, 4B, 4C, 5 and 6. The bare wire portion 511*a* of the first multi-core wire 511 is welded on the first conducting element 502 of the power connector 50. The bare wire portion 512*a* of the second multi-core wire 512 is embedded in and/or welded on the first hollow portion 503*f* of the first connecting segment 503*d* of the power connector 50. Since the internal insulating cover layer 513 of the second multi-core wire 512 is partially extended out of the distal aperture 510*a* of the external insulating cover layer 510 and the terminal part 513*a* of the internal insulating cover layer 513 is embedded in the second hollow portion 503*g* of the second connecting segment 503*e* of the power connector 50, the second connecting segment 503*e* may facilitate fixing the internal insulating cover layer 513. Under this circumstance, the internal insulating cover layer 513 of the second multi-core wire 512 will be no longer shrunk toward the distal aperture 510*a* of the external insulating cover layer 510 even if the power supply cord set 5 has been used for a long period. In other words, the possibility of causing short-circuited between the first multi-core wire 511 and the second multi-core wire 512 is minimized. The power supply cord set 5 further comprises an insulating protective layer 52. The insulating protective layer 52 is sheathed around the connection area between the power cord 51 and the power connector 50 such that the first conducting element 502 of the power connector 50 is partially exposed. After the power connector 50 is coupled with a corresponding electrical connector of an electrical appliance, the first conducting element 502 and the second conducting part 503*b* of the second conducting element 503 are in close contact with corresponding conducting parts of the electrical connector of the electrical appliance so as to transmit electricity to the electrical appliance. In some embodiments, the first conducting element 502 and the second conducting element 503 are used as conductors of an earth wire and a live wire, respectively.

Figure 7A:
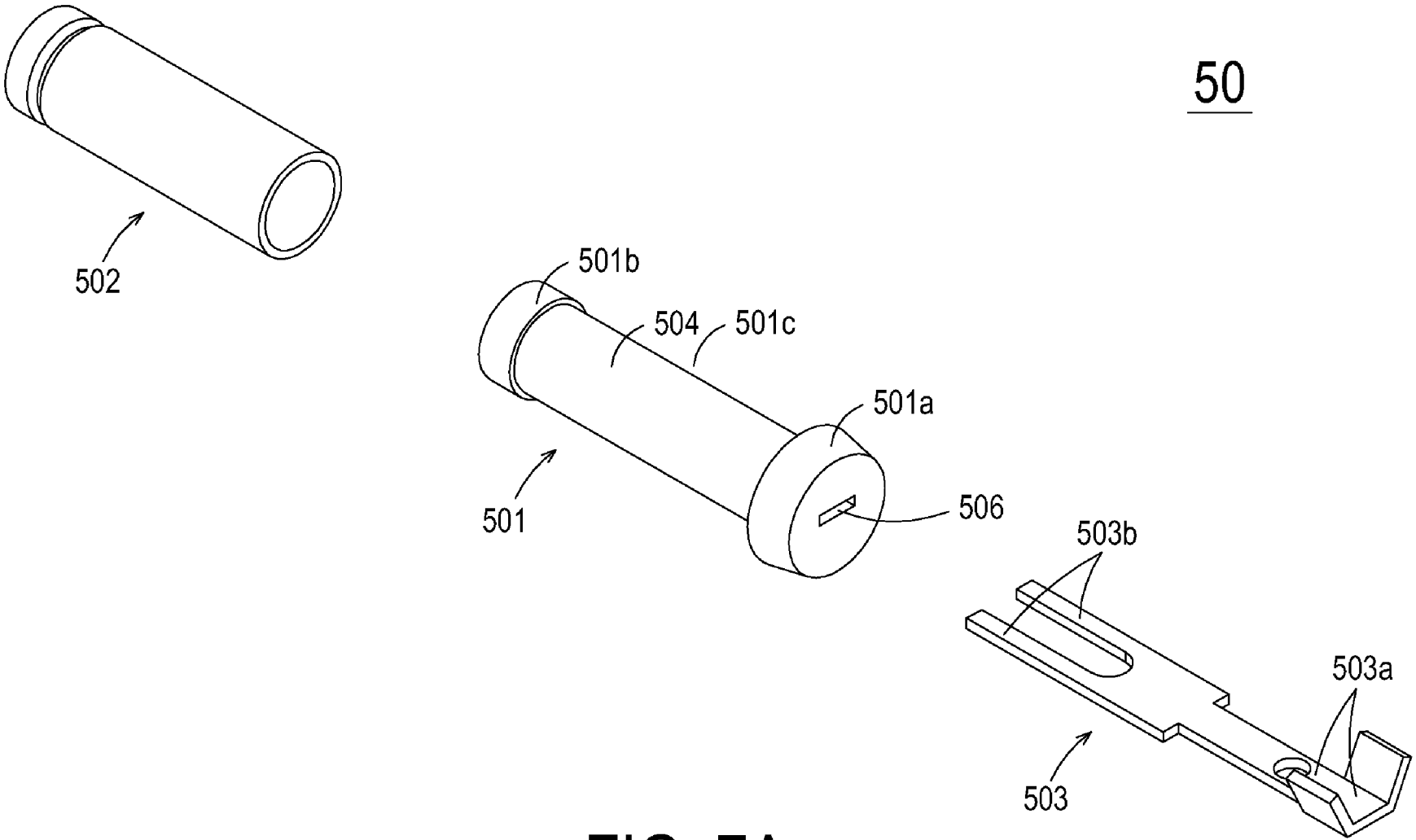
FIG. 7A is a schematic exploded view illustrating another exemplary power connector of the power supply cord set shown in FIG. 3.
Figure 7B:
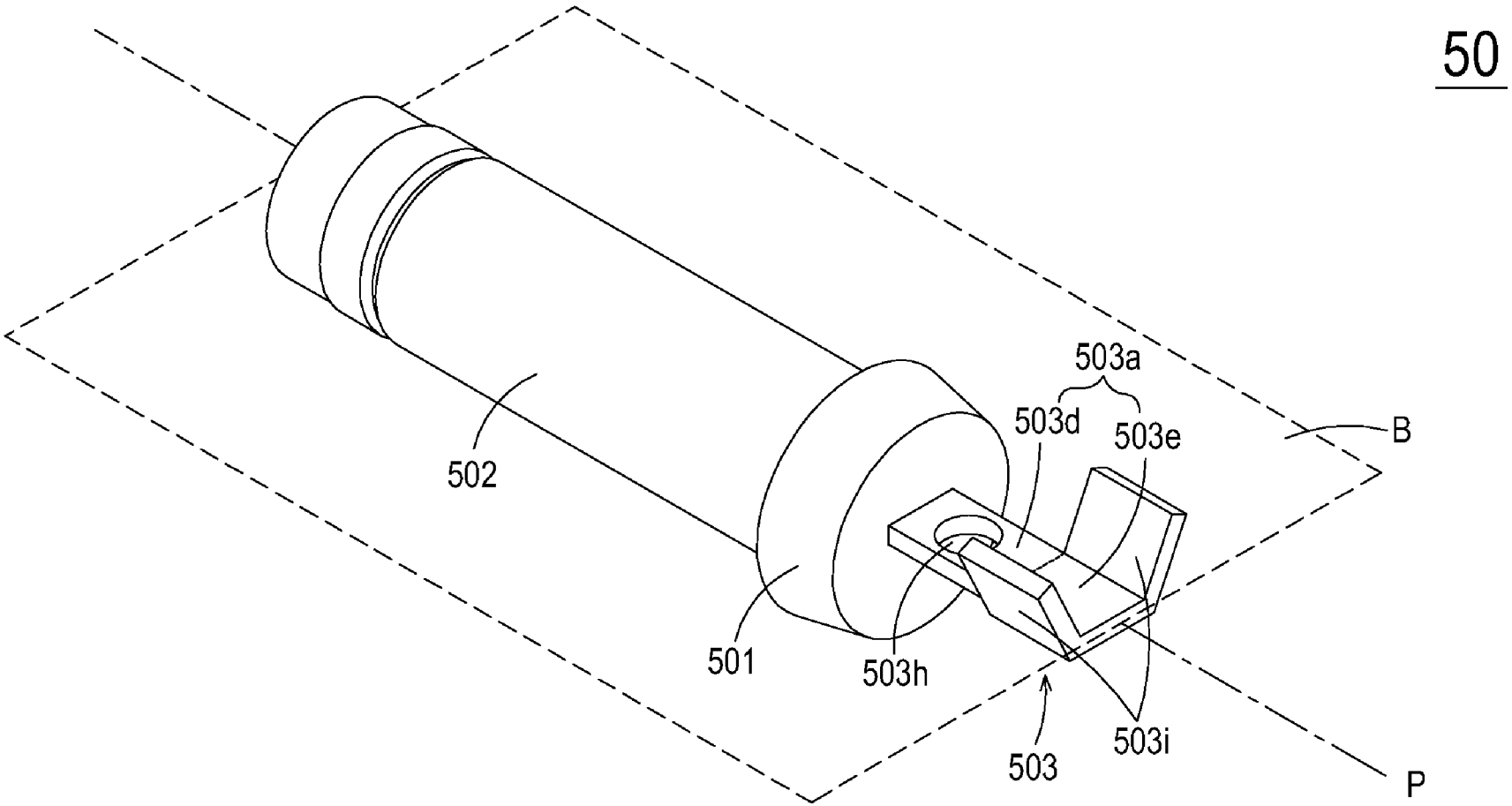
FIG. 7B is a schematic assembled view illustrating the power connector shown in FIG. 7A.
Figure 7C:
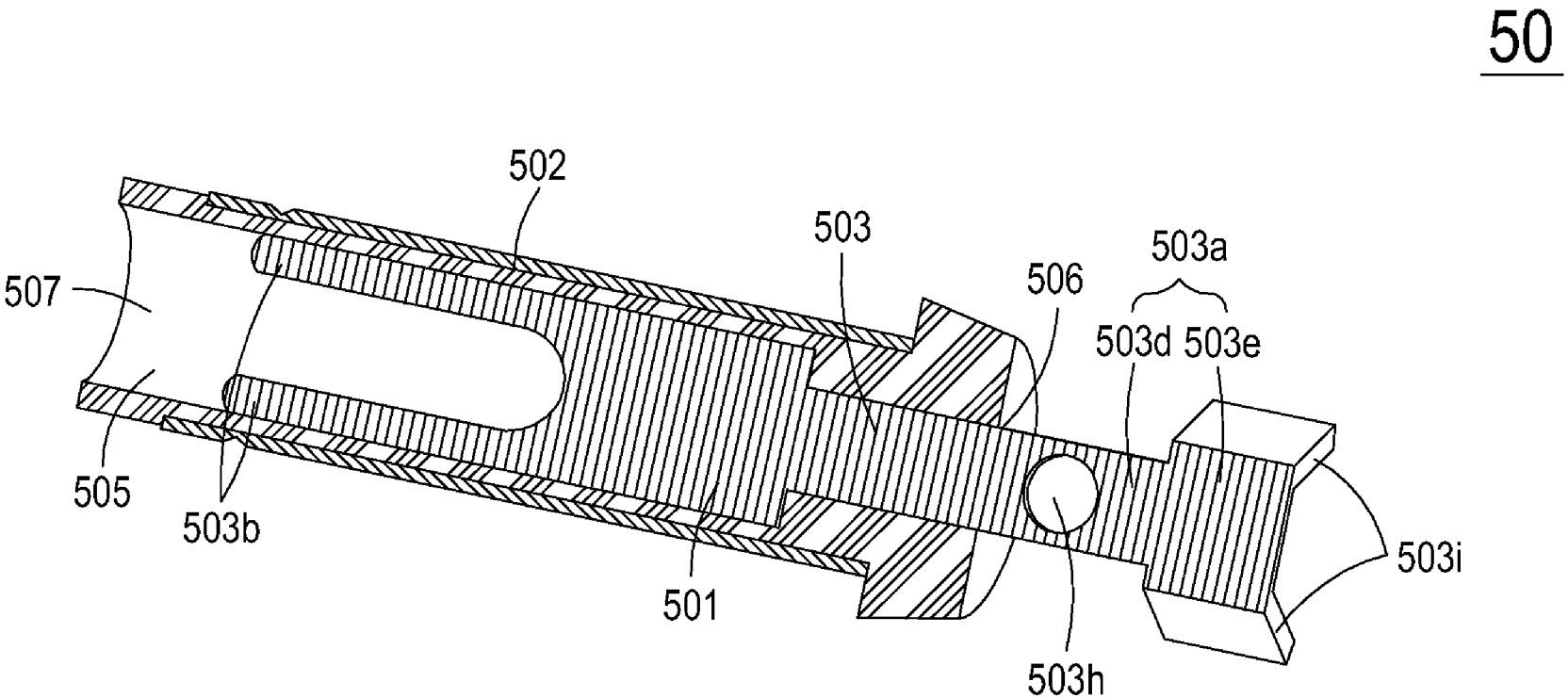
FIG. 7C is a schematic cross-sectional view of the power connector of FIG. 7B taken from the cross-section B.

FIG. 7A is a schematic exploded view illustrating another exemplary power connector of the power supply cord set shown in FIG. 3. FIG. 7B is a schematic assembled view illustrating the power connector shown in FIG. 7A. FIG. 7C is a schematic cross-sectional view of the power connector of FIG. 7B taken from the cross-section B. Please refer to FIGS. 7A, 7B and 7C. In this embodiment, the power connector 50 of the power supply cord set 5 is substantially a barrel power plug. The power connector 50 comprises an insulating body 501, a first conducting element 502 and a second conducting element 503. The insulating body 501 is barrel-shaped. A first protruded ring 501*a* and a second protruded ring 501*b* are respectively formed at a first end and a second end of the insulating body 501 such that a concave portion 501*c* is arranged between the first protruded ring 501*a* and the second protruded ring 501*b*. The insulating body 501 has an external surface 504, a receptacle 505, a first opening 506 and a second opening 507. The first conducting element 502 is also barrel-shaped. The first conducting element 502 is sheathed around the external surface 504 at the concave portion 501*c* of the insulating body 501. The second conducting element 503 is disposed within the receptacle 505. In this embodiment, the second conducting element 503 is a plate-like conducting piece. The second conducting element 503 has a first conducting part 503*a* protruded out of the insulating body 501. That is, the first conducting part 503*a* is extended externally from the first opening 506 of the insulating body 501. The second conducting element 503 is separated and isolated from the first conducting element 502 by the insulating body 501. The second conducting element 503 and the first conducting element 502 are arranged along the coaxial line P. The first opening 506 and the second opening 507 are disposed on opposite ends of the insulating body 501 and communicated with the receptacle 505. The second conducting element 503 has at least a second conducting part 503*b*, which is accommodated in the receptacle 505.

Please refer to FIGS. 7A, 7B and 7C again. The first conducting part 503*a* of the second conducting element 503 comprises a first connecting segment 503*d* and a second connecting segment 503*e*. The first connecting segment 503*d* and the second connecting segment 503*e* are integrally formed. The first connecting segment 503*d* and the second connecting segment 503*e* have a perforation 503*h* and at least one (e.g. two) clamping arm 503*i*, respectively.

Figure 8:
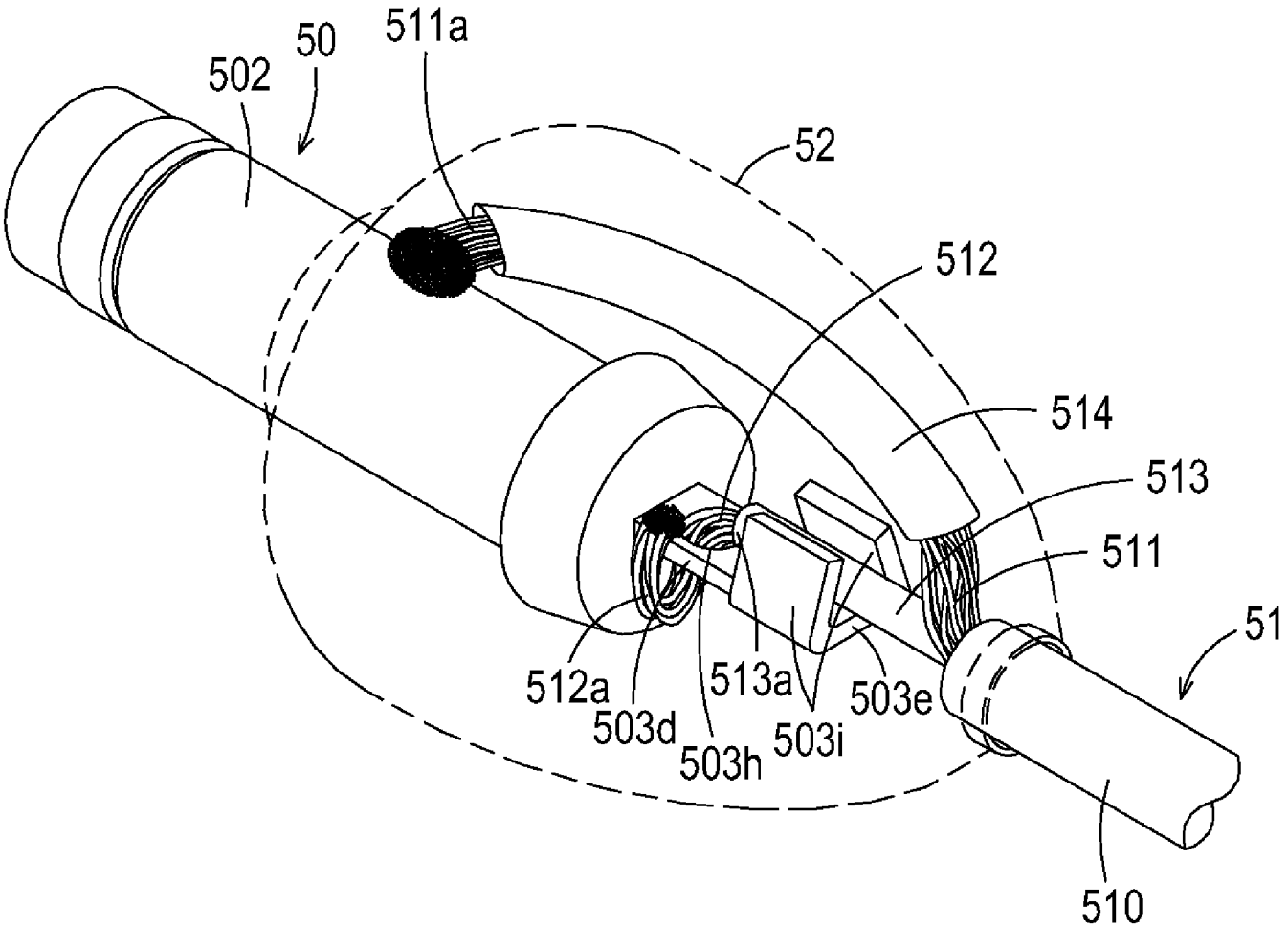
FIG. 8 is a schematic perspective view illustrating the connection between the power connector of FIG. 7 and the power cord of FIG. 5.

FIG. 8 is a schematic perspective view illustrating the connection between the power connector of FIG. 7 and the power cord of FIG. 5. Please refer to FIGS. 3, 5, 7A, 7B, 7C, and 8. The bare wire portion 511*a* of the first multi-core wire 511 is welded on the first conducting element 502 of the power connector 50. The bare wire portion 512*a* of the wire 512 is partially penetrated through the perforation 503*h* and/or then welded on the first connecting segment 503*d* of the first conducting part 503*a* of the second conducting element 503. In addition, the bare wire portion 511*a* of the first multi-core wire 511 is partially sheathed by an insulating tube 514. The internal insulating cover layer 513 of the second multi-core wire 512 is partially extended out of the distal aperture 510*a* of the external insulating cover layer 510. The terminal part 513*a* of the internal insulating cover layer 513 is clamped by the two clamping arms 503*i* at the second connecting segment 503*e* of the power connector 50. As such, the second connecting segment 503*e* may facilitate fixing the internal insulating cover layer 513. Under this circumstance, the internal insulating cover layer 513 of the second multi-core wire 512 will be no longer shrunk toward the distal aperture 510*a* of the external insulating cover layer 510 even if the power supply cord set 5 has been used for a long period. In other words, the possibility of causing short-circuited between the first multi-core wire 511 and the second multi-core wire 512 is minimized. The power supply cord set 5 further comprises an insulating protective layer 52. The insulating protective layer 52 is sheathed around the connection area between the power cord 51 and the power connector 50 such that the first conducting element 502 of the power connector 50 is partially exposed. After the power connector 50 is coupled with a corresponding electrical connector of an electrical appliance, the first conducting element 502 and the second conducting part 503*b* of the second conducting element 503 are in close contact with corresponding conducting parts of the electrical connector of the electrical appliance so as to transmit electricity to the electrical appliance. In some embodiments, the first conducting element 502 and the second conducting element 503 are used as conductors of an earth wire and a live wire, respectively.

Figure 9A:
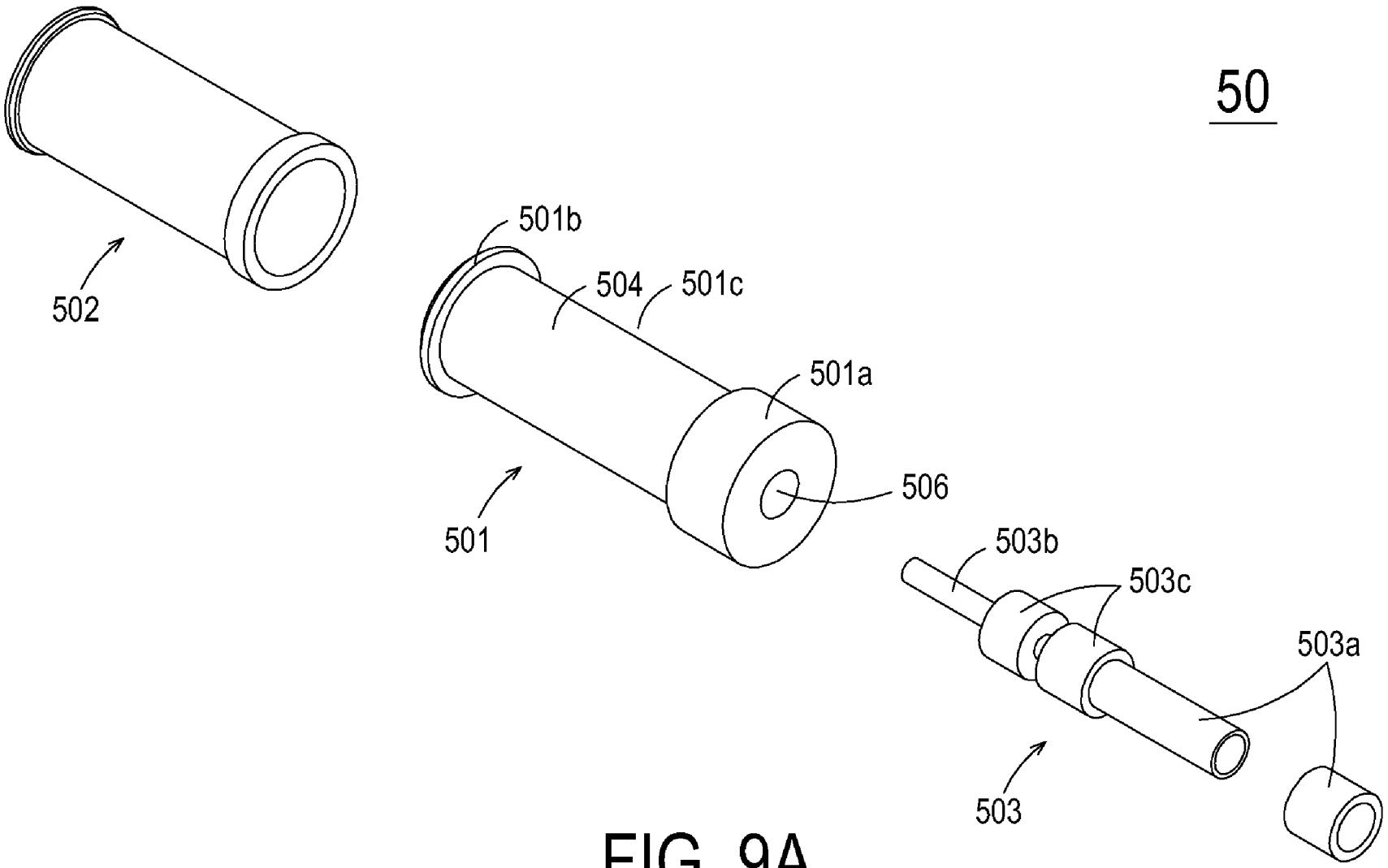
FIG. 9A is a schematic exploded view illustrating a further exemplary power connector of the power supply cord set shown in FIG. 3.
Figure 9B:
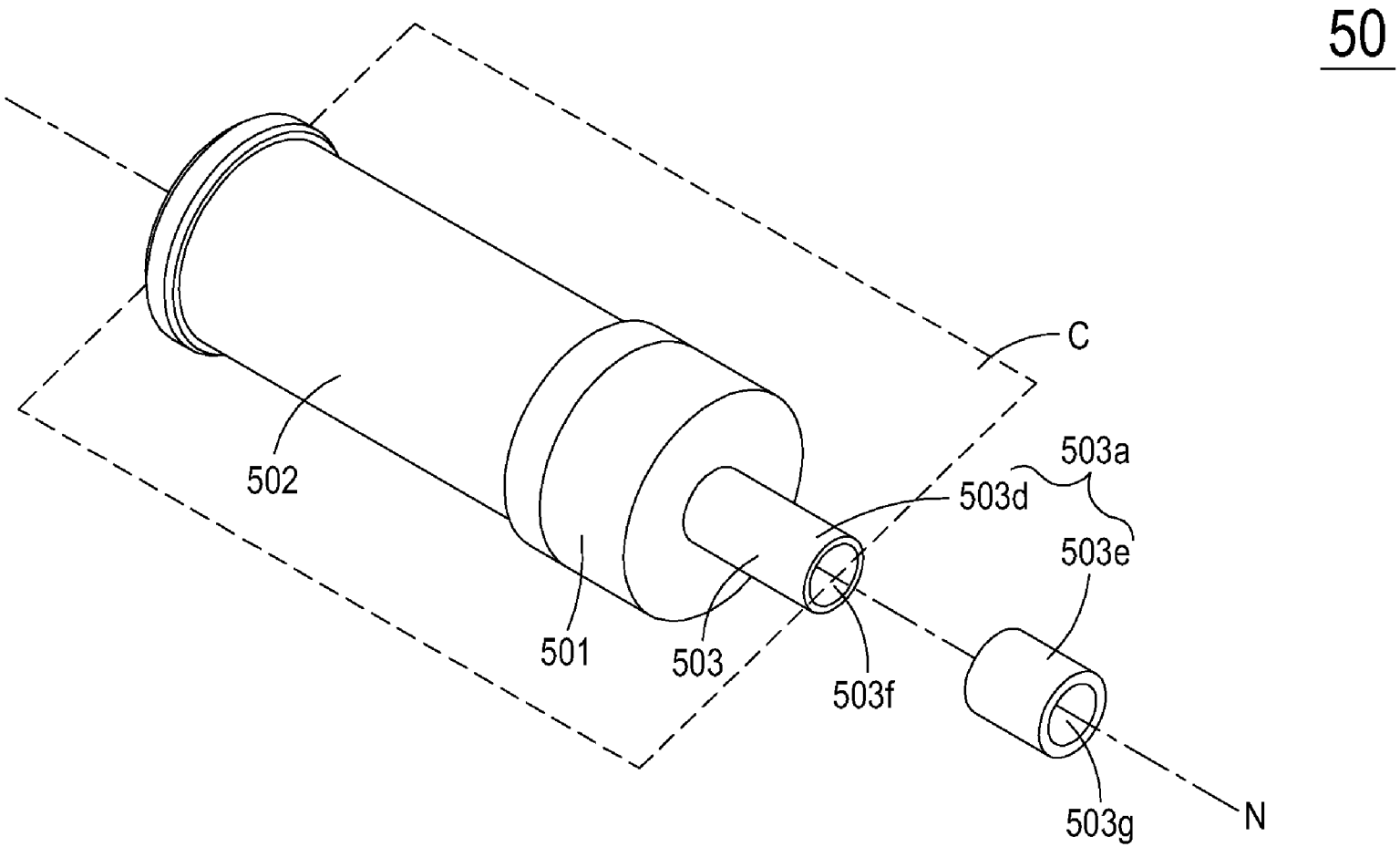
FIG. 9B is a schematic assembled view illustrating the power connector shown in FIG. 9A.
Figure 9C:
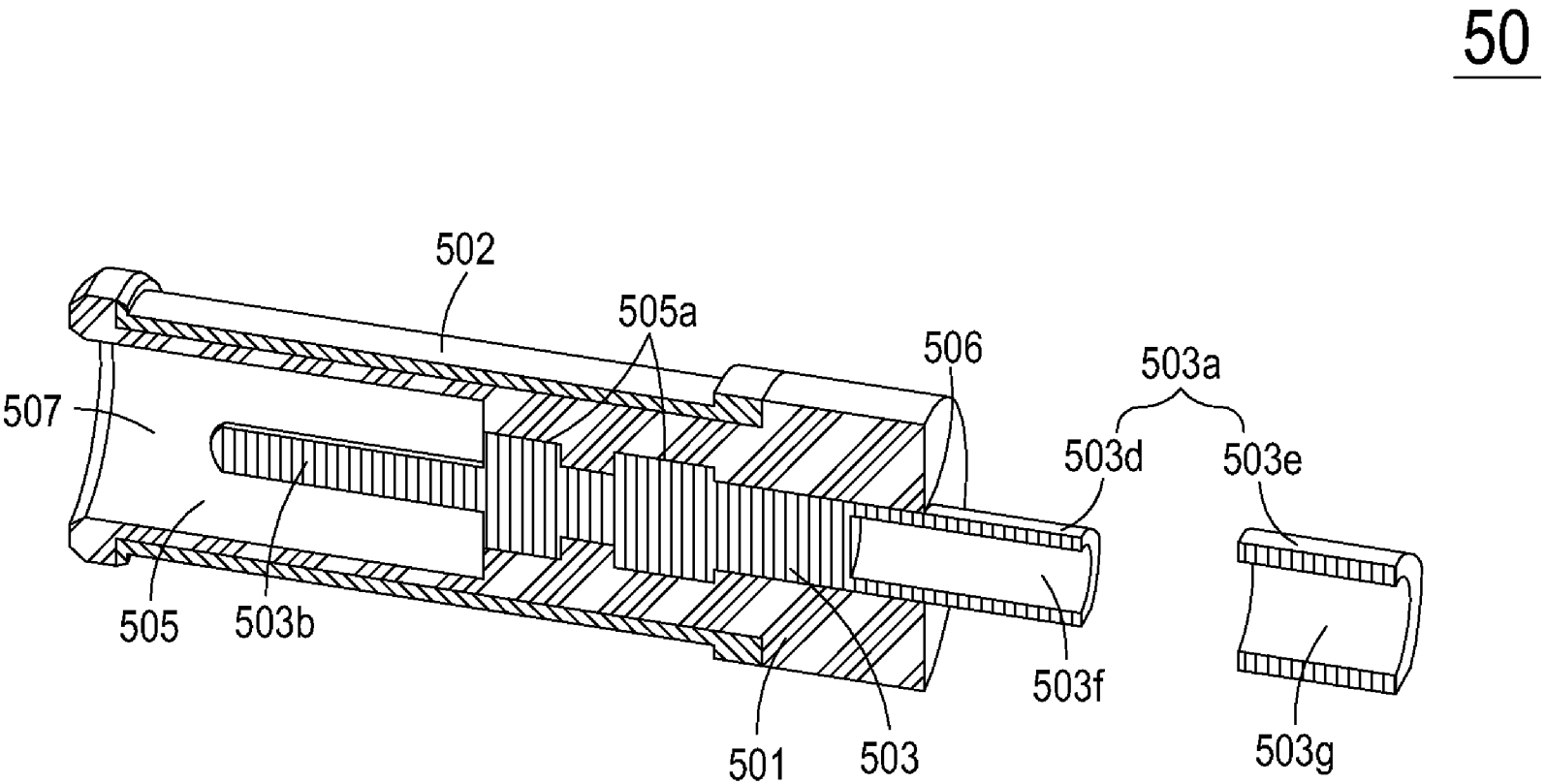
FIG. 9C is a schematic cross-sectional view of the power connector of FIG. 9B taken from the cross-section C.

FIG. 9A is a schematic exploded view illustrating a further exemplary power connector of the power supply cord set shown in FIG. 3. FIG. 9B is a schematic assembled view illustrating the power connector shown in FIG. 9A. FIG. 9C is a schematic cross-sectional view of the power connector of FIG. 9B taken from the cross-section C. Please refer to FIGS. 9A, 9B and 9C. In this embodiment, the power connector 50 of the power supply cord set 5 is substantially a barrel power plug. The power connector 50 comprises an insulating body 501, a first conducting element 502 and a second conducting element 503. The insulating body 501 is barrel-shaped. A first protruded ring 501*a* and a second protruded ring 501*b* are respectively formed at a first end and a second end of the insulating body 501 such that a concave portion 501*c* is arranged between the first protruded ring 501*a* and the second protruded ring 501*b*. The insulating body 501 has an external surface 504, a receptacle 505, a first opening 506 and a second opening 507. The first conducting element 502 is also barrel-shaped. The first conducting element 502 is sheathed around the external surface 504 at the concave portion 501*c* of the insulating body 501. The second conducting element 503 is disposed within the receptacle 505. The second conducting element 503 has a first conducting part 503*a* protruded out of the insulating body 501. The second conducting element 503 is separated and isolated from the first conducting element 502 by the insulating body 501. The second conducting element 503 and the first conducting element 502 are arranged along the coaxial line N. The first opening 506 and the second opening 507 are disposed on opposite ends of the insulating body 501 and communicated with the receptacle 505. The second conducting element 503 has at least a second conducting part 503*b*, which is accommodated in the receptacle 505. In this embodiment, the second conducting part 503*b* is a conducting post. The second conducting element 503 further comprises a first engaging part 503*c*, which is arranged between the first conducting part 503*a* and the second conducting part 503*b* of the second conducting element 503. Corresponding to the first engaging part 503*c*, the insulating body 501 has a second engaging part (not shown) within the receptacle 505. In some embodiments, the first engaging part 503*c* includes at least one protruded ring and the second engaging part includes at least one recess. After the first engaging part 503*c* is engaged with the second engaging part, the second conducting element 503 is firmly fixed on the insulating body 501. Likewise, the first conducting part 503*a* and the second conducting part 503*b* of the second conducting element 503 are arranged along the coaxial line N.

Please refer to FIGS. 9A, 9B and 9C again. The first conducting part 503*a* of the second conducting element 503 comprises a first connecting segment 503*d* and a second connecting segment 503*e*. The second connecting segment 503*e* is detachably connected to the first connecting segment 503*d*. The first connecting segment 503*d* and the second connecting segment 503*e* have a first hollow portion 503*f* and a second hollow portion 503*g*, respectively. After the second connecting segment 503*e* is connected with the first connecting segment 503*d*, the first hollow portion 503*f* and the second hollow portion 503*g* are communicated with each other. The diameter of the first hollow portion 503*f* is smaller than that of the second hollow portion 503*g*, respectively.

Figure 10:
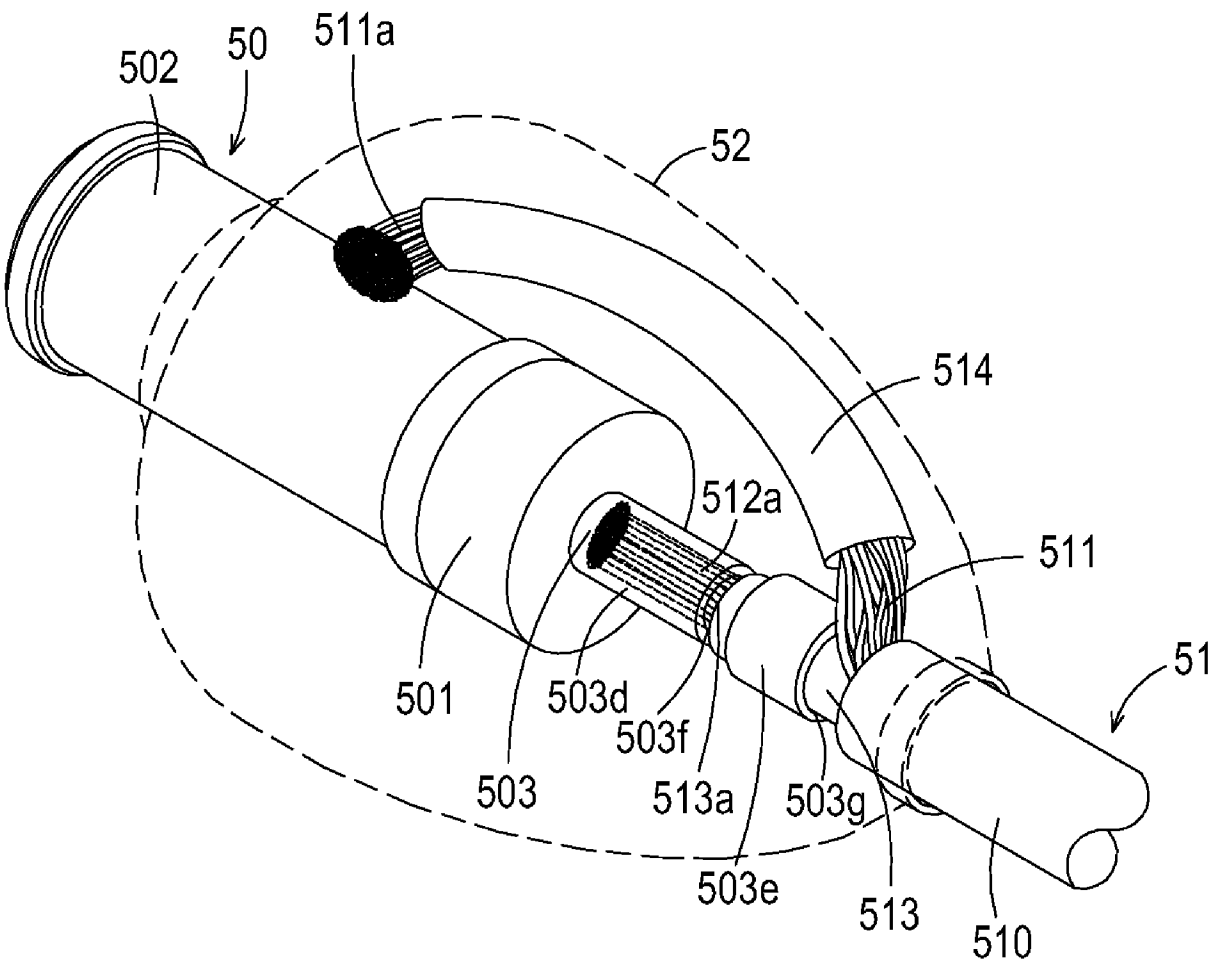
FIG. 10 is a schematic perspective view illustrating the connection between the power connector of FIG. 9 and the power cord of FIG. 5.

FIG. 10 is a schematic perspective view illustrating the connection between the power connector of FIG. 9 and the power cord of FIG. 5. Please refer to FIGS. 3, 5, 9A, 9B, 9C, and 10. The bare wire portion 511*a* of the first multi-core wire 511 is welded on the first conducting element 502 of the power connector 50. The bare wire portion 512*a* of the wire 512 is embedded in and/or welded on the first hollow portion 503*f* of the first connecting segment 503*d* of the power connector 50. In addition, the bare wire portion 511*a* of the first multi-core wire 511 is partially sheathed by an insulating tube 514. The internal insulating cover layer 513 of the second multi-core wire 512 is partially extended out of the distal aperture 510*a* of the external insulating cover layer 510. In addition, since the terminal part 513*a* of the internal insulating cover layer 513 is embedded in the second hollow portion 503*g* of the second connecting segment 503*e* and further contacted with the first connecting segment 503*d*, the second connecting segment 503*e* may facilitate fixing the internal insulating cover layer 513. Under this circumstance, the internal insulating cover layer 513 of the second multi-core wire 512 will be no longer shrunk toward the distal aperture 510*a* of the external insulating cover layer 510 even if the power supply cord set 5 has been used for a long period. In other words, the possibility of causing short-circuited between the first multi-core wire 511 and the second multi-core wire 512 is minimized. The power supply cord set 5 further comprises an insulating protective layer 52. The insulating protective layer 52 is sheathed around the connection area between the power cord 51 and the power connector 50 such that the first conducting element 502 of the power connector 50 is partially exposed. After the power connector 50 is coupled with a corresponding electrical connector of an electrical appliance, the first conducting element 502 and the second conducting part 503*b* of the second conducting element 503 are in close contact with corresponding conducting parts of the electrical connector of the electrical appliance so as to transmit electricity to the electrical appliance. In some embodiments, the first conducting element 502 and the second conducting element 503 are used as conductors of an earth wire and a live wire, respectively.

Figure 11:
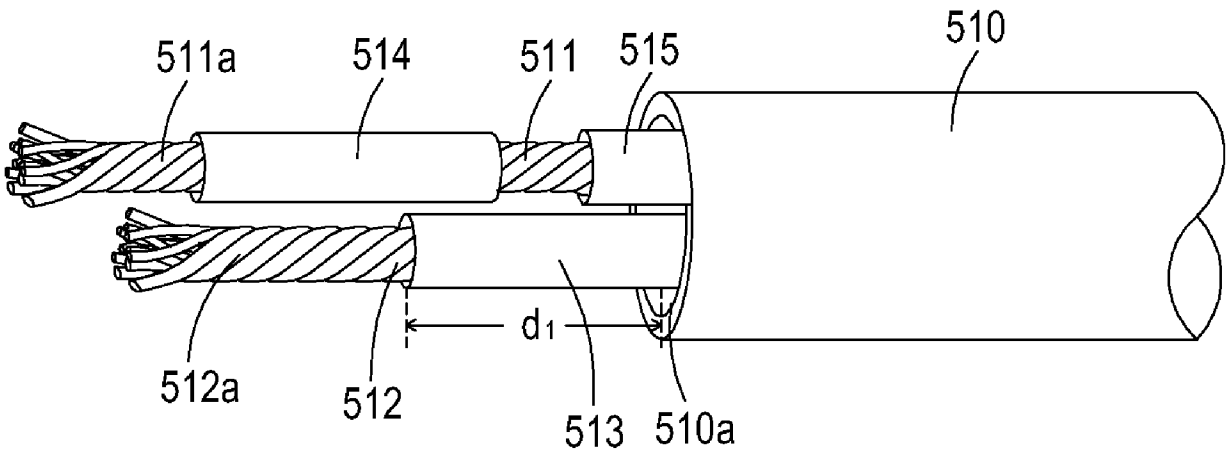
FIG. 11 is a schematic perspective view illustrating another power cord used in the power supply cord set of the present invention.

In the above embodiments, the present invention is illustrated by referring to the coaxial power cord of FIG. 5 as the power cord. Nevertheless, other power cords are also applied to the power supply cord set of the present invention. FIG. 11 is a schematic perspective view illustrating another power cord used in the power supply cord set of the present invention. As shown in FIG. 11, the power cord 51 comprises an external insulating cover layer 510 and at least two multi-core wires 511 and 512. The first multi-core wire 511 is sheathed by an internal insulating cover layer 515 and second multi-core wire 512 is sheathed by another internal insulating cover layer 513. By the internal insulating cover layers 515 and 513, the first multi-core wire 511 and the second multi-core wire 512 are isolated from each other. In addition, the internal insulating cover layers 515 and 513 are covered by the external insulating cover layer 510. The internal insulating cover layer 515 is partially extended out of a distal aperture 510*a* of the external insulating cover layer 510. The internal insulating cover layer 513 of the second multi-core wire 512 is partially extended out of the distal aperture 510*a* of the external insulating cover layer 510 by a length $d_1$. The first multi-core wire 511 and the second multi-core wire 512 have respective bare wire portions 511*a* and 512*a* at their terminals. In addition, the bare wire portion 511*a* of the first multi-core wire 511 is partially sheathed by an insulating tube 514.

Figure 12:
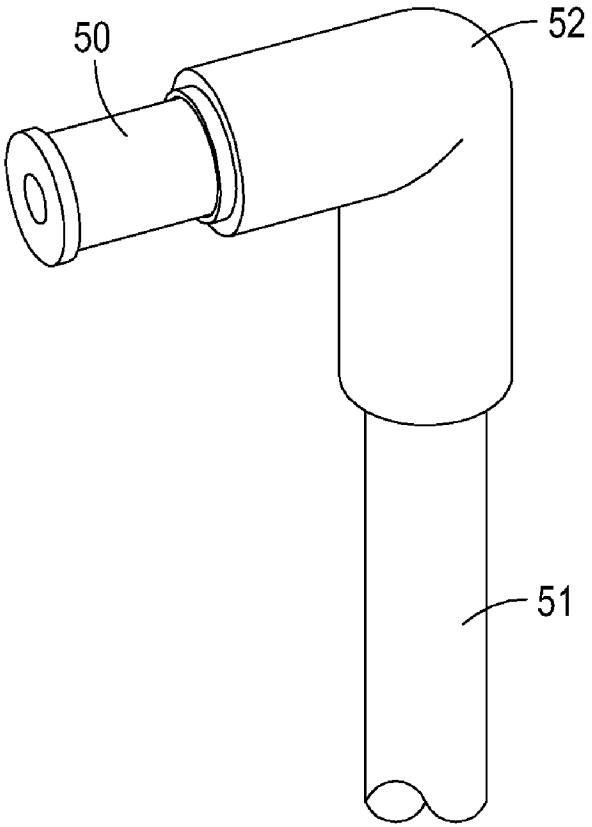
FIG. 12 is a schematic perspective view a power supply cord set according to another preferred embodiment of the present invention.

FIG. 12 is a schematic perspective view a power supply cord set according to another preferred embodiment of the present invention. As shown in FIG. 12, the power supply cord set 5 comprises a power connector 50 and a power cord 51. The power connector 50 is fixed onto an end of the power cord 51 and detachably connected to a corresponding electrical connector of an electrical appliance. Through the power supply cord set 5, electricity can be transmitted from a power source or a power adapter to the electrical appliance. The power supply cord set 5 further comprises an insulating protective layer 52. The insulating protective layer 52 is sheathed around the connection area between the power cord 51 and the power connector 50 for protecting the connection area and alleviating the stress exerted on the connection area. In this embodiment, the insulating protective layer 52 is L-shaped such that the power connector 50 is substantially perpendicular to the power cord 51.

From the above embodiment, since the first multi-core wire and the second multi-core wire of the power cord are securely fixed on the first conducting element and the second connecting element of the power connector, the power supply cord set is more advantageous in comparison with the prior art. Under this circumstance, the internal insulating cover layer of the second multi-core wire will be no longer shrunk toward the distal aperture 510*a* of the external insulating cover layer even if the power supply cord set has been used for a long period. In other words, the possibility of causing short-circuited between the first multi-core wire and the second multi-core wire is minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power supply cord set comprising:

a power connector comprising an insulating body, a first conducting element and a second conducting element, said insulating body being arranged between said first conducting element and said second conducting element such that said first conducting element is isolated from said second conducting element by said insulating body, wherein said second conducting element comprises a first conducting part, which is disposed outside said insulating body and includes a first connecting segment and a second connecting segment; and a power cord comprising a first multi-core wire, a second multi-core wire and an external insulating cover layer, wherein said first multi-core wire and said second multi-core wire are covered by said external insulating cover layer, said second multi-core wire is sheathed by an internal insulating cover layer such that said first multi-core wire and said second multi-core wire are isolated from each other, said first multi-core wire and said second multi-core wire have respective bare wire portions, said internal insulating cover layer is partially extended out of a distal aperture of said external insulating cover layer, said bare wire portion of said first multi-core wire is connected to and fixed on said first conducting element of said power connector, said bare wire portion of said second multi-core wire is connected to and fixed on said first connecting segment of said first conducting part of said second conducting element, and a terminal part of said internal insulating cover layer is fixed by said second connecting segment.

2. The power supply cord set according to claim 1 wherein said power supply cord set further comprises an insulating protective layer, which is sheathed around a connection area between said power cord and said power connector such that said first conducting element of said power connector is partially exposed.

3. The power supply cord set according to claim 1 wherein said power connector is a barrel power plug, said insulating body is barrel-shaped, said first conducting element is barrel-shaped and sheathed around insulating body, and said second conducting element and said first conducting element are arranged along a coaxial line.

4. The power supply cord set according to claim 1 wherein said insulating body has a receptacle, and said second conducting element further comprises at least a second conducting part accommodated in said receptacle.

5. The power supply cord set according to claim 1 wherein said insulating body further comprises an external surface, a first opening and a second opening, wherein said first opening and said second opening are disposed on opposite ends of said insulating body and communicated with said receptacle, said first conducting element is sheathed around said external surface, and said first conducting part of said second conducting element is extended externally from said first opening of said insulating body.

6. The power supply cord set according to claim 4 wherein said second conducting element further comprises a first engaging part arranged between said first conducting part and said second conducting part of the second conducting element, and said insulating body has a second engaging part within said receptacle to be engaged with said first engaging part.

7. The power supply cord set according to claim 1 wherein a first protruded ring and a second protruded ring are respectively formed both ends of said insulating body such that a concave portion is arranged between said first protruded ring and said second protruded ring.

8. The power supply cord set according to claim 1 wherein said first connecting segment and said second connecting segment of said first conducting part of the second conducting element are integrally formed, and said first connecting segment and said second connecting segment have a first hollow portion and a second hollow portion, respectively, wherein said first hollow portion and said second hollow portion are communicated with each other, and said first hollow portion is smaller than said second hollow portion in diameter.

9. The power supply cord set according to claim 8 wherein said bare wire portion of said first multi-core wire is welded on said first conducting element of said power connector, said bare wire portion of said second multi-core wire is embedded in and/or welded on said first hollow portion of said first connecting segment of said power connector, and said terminal part of said internal insulating cover layer is embedded in said second hollow portion of said second connecting segment of said power connector, thereby facilitating fixing said internal insulating cover layer.

10. The power supply cord set according to claim 1 wherein said first connecting segment and said second connecting segment of said first conducting part of the second conducting element are integrally formed, and said first connecting segment and said second connecting segment have a perforation and at least one clamping arm, respectively.

11. The power supply cord set according to claim 10 wherein said bare wire portion of said first multi-core wire is welded on said first conducting element of said power connector, said bare wire portion of said second multi-core wire is partially penetrated through said perforation and/or welded on said first connecting segment of said power connector, and said terminal part of said internal insulating cover layer is clamped by said at least one clamping arm, thereby facilitating fixing said internal insulating cover layer.

12. The power supply cord set according to claim 1 wherein said first connecting segment and said second connecting segment of said first conducting part of the second conducting element are detachably connected to each other, and said first connecting segment and said second connecting segment have a first hollow portion and a second hollow portion, respectively, wherein said first hollow portion and said second hollow portion are communicated with each other, and said first hollow portion is smaller than said second hollow portion in diameter.

13. The power supply cord set according to claim 12 wherein said bare wire portion of said first multi-core wire is welded on said first conducting element of said power connector, said bare wire portion of said second multi-core wire is embedded in and/or welded on said first hollow portion of said first connecting segment of said power connector, and said terminal part of said internal insulating cover layer is embedded in said second hollow portion of said second connecting segment of said power connector, thereby facilitating fixing said internal insulating cover layer.

14. The power supply cord set according to claim 1 wherein said power cord is a coaxial power cord, and said first multi-core wire is arranged between said internal insulating cover layer and said external insulating cover layer.

15. The power supply cord set according to claim 1 wherein said bare wire portion of said first multi-core wire is partially sheathed by an insulating tube.

16. The power supply cord set according to claim 1 wherein said second conducting part of said first conducting element is a conducting post or a conducting piece.

17. A power connector to be coupled with a power cord, said power cord comprising a first multi-core wire and a second multi-core wire, said power connector comprising:

a first conducting element;

a second conducting element comprising a first conducting part, which includes a first connecting segment and a second connecting segment; and an insulating body arranged between said first conducting element and said second conducting element such that said first conducting element is isolated from said second conducting element by said insulating body, said first conducting part of said second conducting element being disposed outside said insulating body, wherein said bare wire portion of said first multi-core wire is connected to and fixed on said first conducting element of said power connector, said bare wire portion of said second multi-core wire is connected to and fixed on said first connecting segment of said first conducting part of said second conducting element, and a terminal part of an internal insulating cover layer of said second multi-core wire is fixed by said second connecting segment.

18. The power connector according to claim 17 wherein said power cord further comprises an external insulating cover layer, said first multi-core wire and said second multi-core wire are covered by said external insulating cover layer, said first multi-core wire and said second multi-core wire are isolated from each other, said internal insulating cover layer of said second multi-core wire is partially extended out of a distal aperture of said external insulating cover layer, and a terminal part of said internal insulating cover layer is fixed by said second connecting segment.

* * * * *